US006437514B1

(12) United States Patent
Kurata et al.

(10) Patent No.: US 6,437,514 B1
(45) Date of Patent: Aug. 20, 2002

(54) AC PLASMA DISPLAY DEVICE

(75) Inventors: Takatsugu Kurata; Makoto Kawachi, both of Ibaraki (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/702,723

(22) Filed: Nov. 1, 2000

(30) Foreign Application Priority Data

Nov. 2, 1999 (JP) ..... 11-311995

(51) Int. Cl.[7] ..... G09G 3/10
(52) U.S. Cl. ..... 315/169.4; 313/581
(58) Field of Search ..... 315/169.4, 169.1; 313/484, 502, 504, 581, 306, 307; 345/60, 65

(56) References Cited

U.S. PATENT DOCUMENTS 5,793,158 A * 8/1998 Wedding, Sr. ..... 313/493
5,828,356 A * 10/1998 Stoller ..... 345/60
6,181,305 B1 * 1/2001 Nguyen et al. ..... 315/169.4

* cited by examiner

*Primary Examiner*—Don Wong
*Assistant Examiner*—Thuy Vinh Tran
(74) *Attorney, Agent, or Firm*—Parkhurst & Wendel, LLP

(57) ABSTRACT

An AC plasma display device allows the display quality improved, to perform a write operation reliably and reduce a write operation period by reducing discharge delay at the write operation. Pairs of scan electrode and sustain electrode are arranged on a front substrate in parallel and covered by a dielectric layer. A protect film is formed on the dielectric layer. Data electrodes covered by an insulating layer are formed on a rear substrate. Partitions are located on the insulating layer in parallel with and between data electrodes. Conductive phosphor layers made of a mixture comprising an insulating phosphor material and a conductive material are formed from the surface of the insulating layer to each side of the partitions. Ignition gaps are defined between a surface of the protective film and peaks of the phosphor layer close to the surface.

8 Claims, 7 Drawing Sheets

AC PLASMA DISPLAY DEVICE

FIELD OF THE INVENTION

The present invention relates to an AC plasma display device used for a television receiver, an information display terminal, and other image displays.

BACKGROUND OF THE INVENTION

FIG. 8 illustrates a panel structure example of a conventional AC plasma display device.

Scan electrode 23 and sustain electrode 24, which are covered by dielectric layer 22, are arranged on front substrate 21 in a pair in parallel. Protect film 25, which is an insulating film easy to be discharged, is formed on dielectric layer 22.

Data electrodes 28 covered by insulating layer 27 are arranged on rear substrate 26. Partitions 29 are located on insulating layer 27 in parallel with and between data electrodes 28. Phosphor layer 30 is formed on a surface of insulating layer 27 and side walls of partition 29. Front substrate 21 and Rear substrate 26 are placed facing to each other sandwiching discharge space 31, so as for scan electrode 23 and sustain electrode 24 to extend in an perpendicular direction to data electrode 28.

Discharge space 31 encloses a mixture of xenon and at least one of helium, neon, and argon as an ionizable gas. One of data electrode 28 and one pair of scan electrode 23 and sustain electrode 24 are arranged to form an intersection region sandwiched by two walls of adjacent partitions 29, and the intersection region corresponds to one discharge cell. Therefore, a plurality of discharge cells 32 are arranged in a plane between front substrate 21 and rear substrate 26.

Next, an operation of the display panel is described.

First, priming discharges occur between all pairs of scan electrode 23 and sustain electrode 24, to accumulate wall charge on a surface of protective film 25.

Second, a scan pulse voltage is applied to one of scan electrode 23, and a write pulse voltage is applied to data electrode 28 corresponding to discharge cell 32 one of display data is written to. This causes write discharge at the discharge cell 32 to do write operation. The write operations are performed to all of scan electrodes 23 in sequence.

After the write operations are done to all of scan electrodes 23, a pulse voltage is applied alternately to all of scan electrodes 23 and all of sustain electrodes 24 to cause discharges at the discharge the cells data are written to. This causes phosphor layers 30 to emit lights. The light emissions perform a panel display.

However, when the above-mentioned operation performs an image display, a write operation failure may not make a cell emit a light, even when the cell should emit a light. In other words, it is known that a non-emitting cell arises in the panel on a random basis and may cause display quality to lower. It is considered that a cause of the write operation failure is a discharge delay phenomenon, which is a general characteristic of a discharge phenomenon.

Generally called a discharge delay is a period between an instance when a voltage higher than or equal to a discharge voltage for a gap is applied across the gap; and an instance when a discharge occurs across the gap. The discharge delay includes a formation delay determined by discharge cell structure and panel formation materials, and a statistical delay reflecting probability factor of the discharge. In particular, the statistical delay is micro second orders of period longer than the formation delay, and becomes a main cause of the write operation failure. On the other hand, a few micro seconds, a rather long, is required to one scan electrode for the write pulse to perform the write operation reliably. Therefore, a ratio of the write operation period to a whole drive pulse period becomes large.

SUMMARY OF THE INVENTION

The present invention aims to provide an AC plasma display panel which can reduce a writ operation period and has a high display quality with a reliable write operation by reducing discharge delay in the write operation.

A plasma display panel of the present invention comprises two substrates facing to each other having a plurality of discharge cells arranged in a plane between the two substrates, where each of the cells having an ignition gap, at which a pilot discharge acting as "a pilot flame" occurs to stimulate a main discharge. This construction allows a write discharge to occur reliably with the pilot discharge occurring at the ignition gap acting as "the pilot flame."

DESCRIPTION OF THE PREFERRED EMBODIMENTS

How a write operation period is reduced is of importance to an increase in a pulse drive speed, or to a pulse drive for a large frame panel having large numbers of scan lines.

A plasma display device in accordance with an embodiment of the present invention aiming to reduce a write operation period is described with reference to FIGS. 1 through 6 as follows.

First Embodiment

Figure 1:
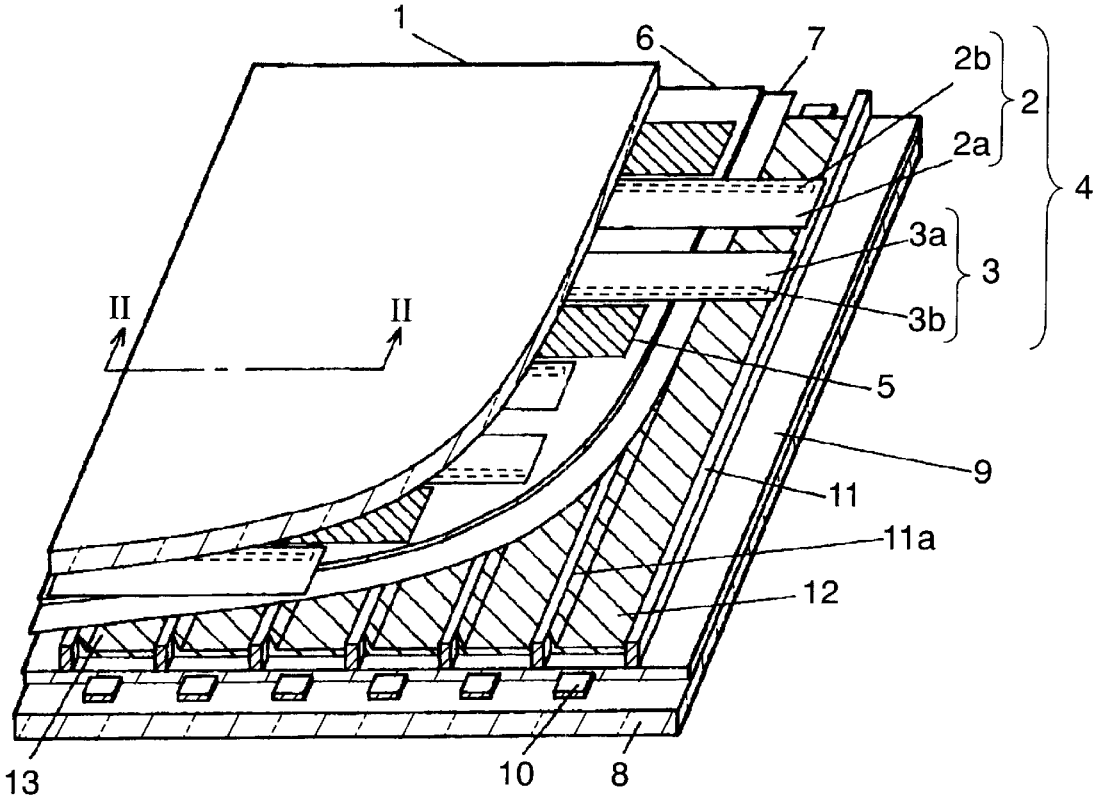
FIG. 1 shows a perspective view of a panel structure tearing off a part of a plasma display device in accordance with an embodiment of the present invention.
Figure 2:
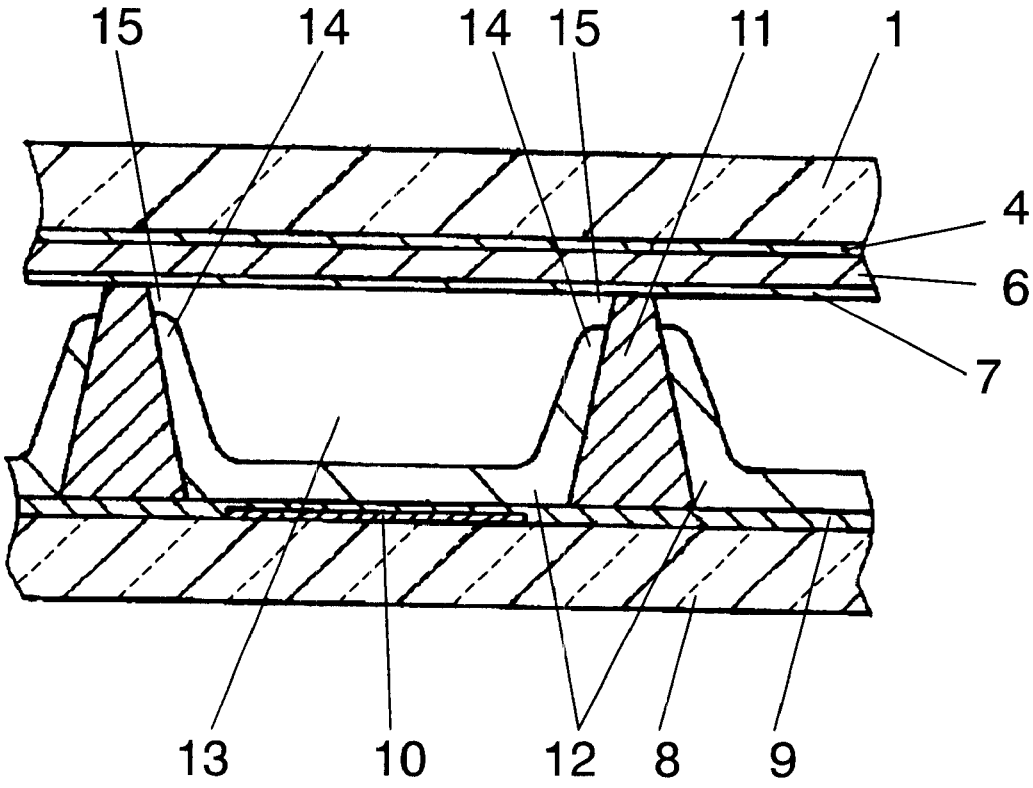
FIG. 2 is a cross-sectional view of a main portion of the panel.

FIG. 1 illustrates an example of a panel structure of a plasma display device in accordance with an embodiment of the present invention. FIG. 2 is a sectional view taken on line II—II of FIG. 1. As shown in FIG. 1, a pair of scan electrode 2 and sustain electrode 3 forms display electrode 4 in a stripe shape on front substrate 1 made of a transparent glass substrate and the like. Light shielding layer 5 is located between adjacent display electrodes 4 on front substrate 1. Scan electrode 2 and sustain electrode 3 comprise transparent electrodes 2*a* and 3*a*, and bus lines 2*b* and 3*b* made of silver and the like electrically connected to the transparent electrodes 2*a* and 3*a* respectively. Dielectric layer 6 is formed on front substrate 1 so as to cover plural pairs of electrodes. Protect film 7, which is an insulating film easy to be discharged, is formed on the dielectric layer 6.

A plurality of data electrodes 10 in a stripe shape covered by insulating layer 9 is formed on rear substrate 8 facing to front substrate 1 so as to extend in an perpendicular direction to display electrodes 4 comprising scan electrodes 2 and sustain electrodes 3. A plurality of partitions 11 in a stripe shape is placed on insulating layer 9 between data electrodes 10 in parallel with data electrode 10.

Conductive phosphor layer 12 is formed on sides 11*a* of partition 11 and a surface of insulating layer 9 so as to define a gap between a surface of phosphor layer 12 and a surface of substrate 1 having display electrodes 4, at which a main discharge occurs .

Substrate 1 and substrate 8 are placed facing to each other, so as for pairs of scan electrodes 2 and sustain electrodes 3, and data electrodes 10 to extend in a perpendicular direction to each other, and to define a narrow discharge space between the pair of the electrodes 2, 3 and the electrodes 10, and the discharge space is sealed around the substrates' sides. The discharge space encloses helium, neon, argon and xenon or a mixture of some of them as an ionizable gas.

Partitions 11 divide the discharge space into plural sections. This forms a plurality of discharge cells 13 at an intersection region of display electrode 4 and data electrode 10. Phosphor layers 12, from which red, blue, and green lights are emitted by discharges, are located in discharge cells 13 in sequence respectively one color to one discharge cell.

Phosphor layer 12 comprises insulating phosphor material and conductive material, which are mixed, and the layer 12 is conductive. Powdery or whiskery zinc oxide (ZnO) is used as the conductive material.

As described above, a narrow space is defined between peak 14 of phosphor layer 12 coated on the side of partition 11 and protect film 7 covering substrate 1, and the narrow space acts as an ignition gap. In more detail, ignition gap 15 is defined between: a surface of a formation, which comprises dielectric layer 6, scan electrode 2, sustain electrode 3 and protect film 7, and is formed on substrate 1; and phosphor layer 12 close to the surface.

Figure 3A:
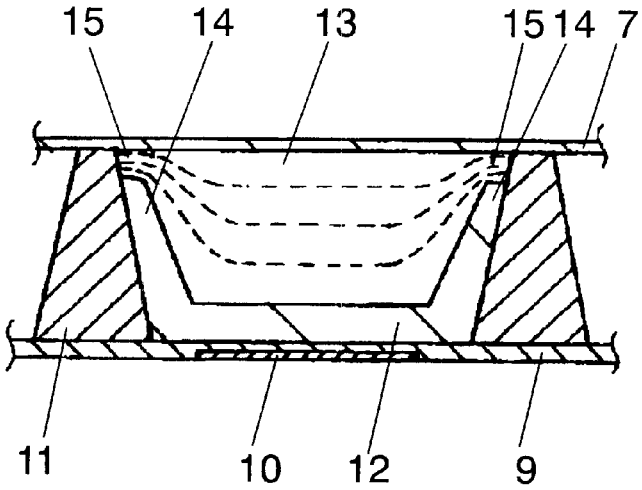
FIGS. 3(*a*) and (*b*) are illustrations of potential distribution for a panel of a first embodiment in accordance with the present invention and a conventional panel respectively.
Figure 3B:
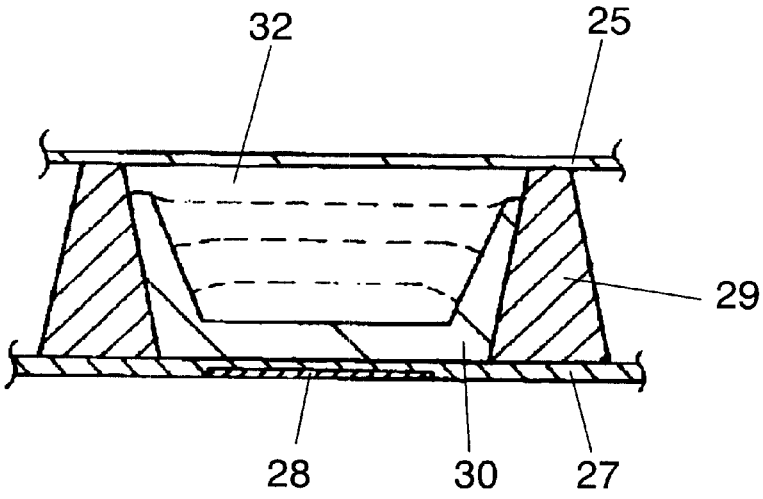
FIG. 3B PRIOR ART

FIG. 3(*a*) is an illustration of electric potential distribution in discharge cell 13 for a panel of the embodiment. FIG. 3(*b*) is an illustration of electric potential distribution in discharge cell 32 for a conventional panel.

In the conventional panel, the potential distribution takes a shape illustrated by broken lines in FIG. 3(*b*), because the phosphor layer is an insulator. On the other hand, the potential distribution in the panel of the embodiment takes a shape illustrated by broken lines in FIG. 3(*a*), because the phosphor layer is conductive. This potential distribution is clearly different from the potential distribution in the conventional panel. Here in FIG. 3(*a*), strong electric field concentrations occur at spaces between: peaks 14 of phosphor layer 12 coated on the sides of partition 11; and protect film 7. These spaces effectively become ignition gaps 15 having an extremely short discharge gap.

When a write pulse voltage is applied, a very strong electric field concentration occurs at ignition gap 15, to which a voltage far exceeding the discharge voltage of ignition gap 15 is applied. As a result, a discharge starts at ignition gap 15 with almost no long discharge delay. Since charged particles produced by the discharge, which is a pilot discharge, act as "a pilot flame", and stimulate a discharge, a write discharge as a main discharge occurs at discharge cell 13 with almost no statistical delay.

Figure 4:
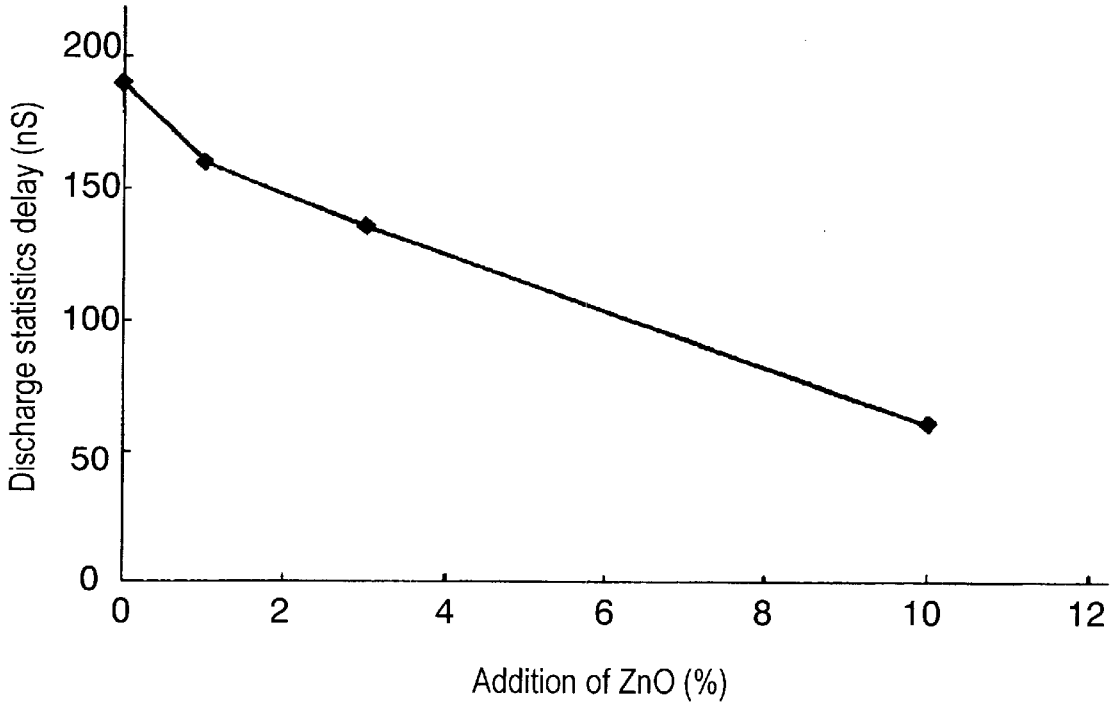
FIG. 4 is a graph of a measurement result of a discharge statistical delay of the panel in accordance with the first embodiment of the present invention.

A measurement result of the discharge statistical delay in the write discharge experiment is shown in FIG. 4.

Here, $Y_2O_3$:Eu is used for a red phosphor layer, and $BaMg_2Al_{14}O_{24}$:Eu is used for a blue phosphor layer. A mixture of $Zn_2SiO_4$:Mn and ZnO is used for a green phosphor layer. Discharge statistical delays are measured with 100 discharge cells to each color of phosphor layer, with a wave form of write discharge current observed on an oscilloscope screen. Scan pulse with voltage: 70 volts, pulse width: 1.5 micro second, and write pulse with voltage: 60 volts, pulse width: 1.5 micro second are used to make a write discharge.

The panel used in the above-mentioned experiment comprises a cell with length in horizontal direction: 1080 $\mu$m, length in vertical direction: 360 $\mu$m, and height: 120 $\mu$m of partition 11.

The vertical axis of FIG. 4 shows a discharge statistical delay of a discharge cell where a green phosphor layer is formed. The horizontal axis shows a weight mixture ratio of ZnO to $Zn_2SiO_4$ (green phosphor).

When ZnO is not mixed in a conventional panel, the conventional panel shows that the statistical delay was the longest and a green discharge cell is a main cause of a write operation failure. On the other hand, the result in FIG. 4 shows that the mixture of ZnO into the green phosphor makes the statistical delay shorter, and write discharge reliable. Furthermore, a period a write operation needs can be reduced.

Second Embodiment

Figure 5:
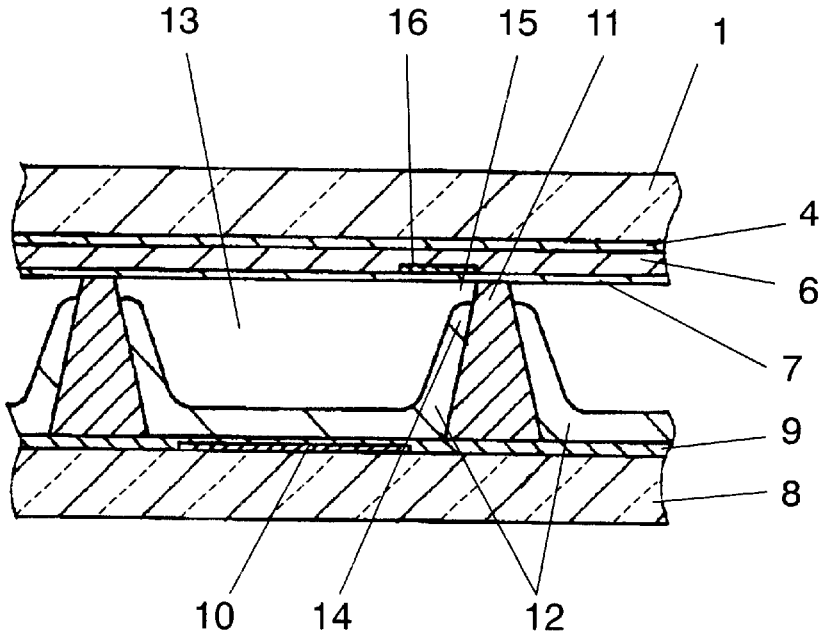
FIG. 5 is a cross-sectional view of a main portion of a panel in accordance with a second embodiment of the present invention.

FIG. 5 is a cross-sectional view of a main portion of a panel in accordance with a second embodiment of the present invention.

A different point of a panel in FIG. 5 from the panel of the first embodiment is that floating conductor 16, which is electrically floating, is formed between dielectric layer 6 at a position of ignition gap 15 and protect film 7.

Floating conductor 16 may be made of indium-tin oxide (ITO), tin oxide ($SnO_2$) and other transparent materials or silver and other opaque materials.

Figure 6:
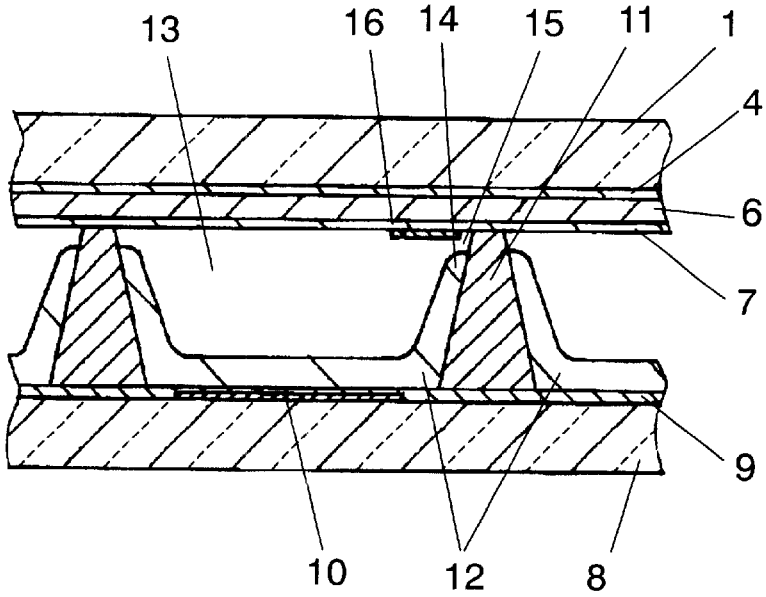
FIG. 6 is a cross-sectional view of a main portion of another panel in accordance with the second embodiment of the present invention.

Floating conductor 16 may be formed on a surface of protective film 7 as shown in FIG. 6.

If dielectric layer 6 is resistant to ion spattering during the discharge, and is made of materials having high coefficient of secondary electron emission, protective film 7 may not be formed.

Figure 7A:
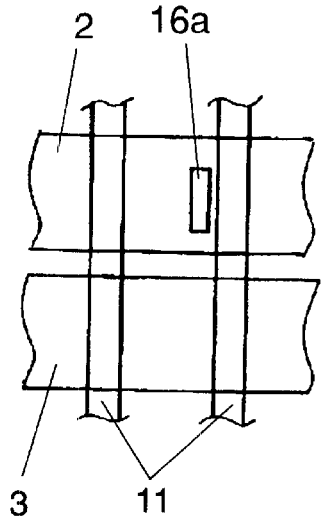
FIGS. 7(*a*), (*b*), and (*c*) are rough drawings to show examples of floating conductor location.
Figure 7B:
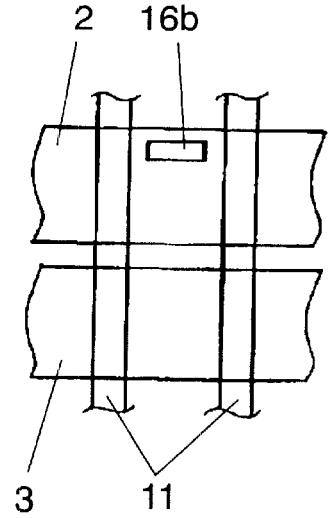
Figure 7C:
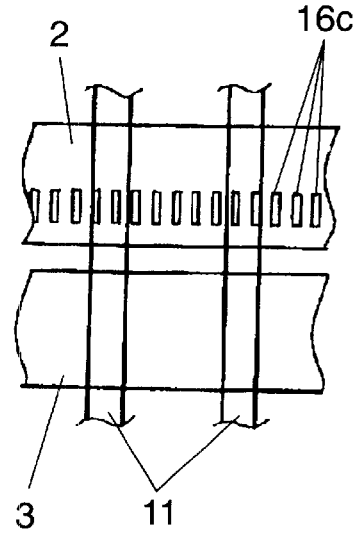
Figure 8:
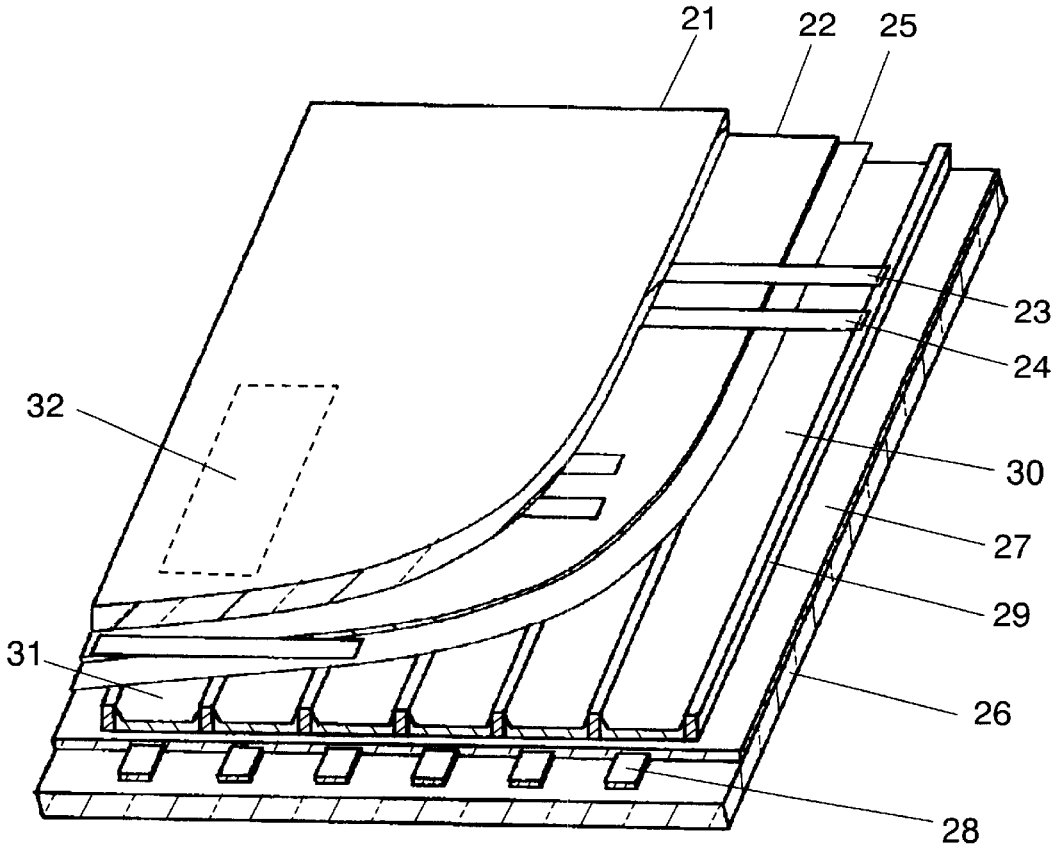
FIG. 8 PRIOR ART
FIG. 8 shows a perspective view of a panel structure tearing off a part of a conventional plasma display device.

FIG. 7 shows rough drawings of two-dimensional relations of scan electrode 2, sustain electrode 3, partitions 11 and floating conductor 16 to each other. FIGS. 7(*a*), (*b*), and (*c*) are different examples of the floating conductors in shape and location.

As shown in FIGS. 7(*a*), (*b*), and (*c*), floating conductors 16*a*, 16*b*, and 16*c* are arranged close to positions of ignition gaps respectively.

In a construction of FIG. 7(*b*), scan electrode 2 comprises transparent electrode 2*a* and opaque metal bus line 2*a*. Here, floating conductor 16*b* is formed under metal bus line 2*b*. Therefore, even if floating conductor 16*b* is made of an opaque material, visible-light transmittance does not change, and luminous intensity does not lower.

Furthermore, as an array of floating conductors 16*c* extends in perpendicular direction to partitions 11, an alignment between front substrate 1 and rear substrate 8 is easier in the construction of FIG. 7(*c*) than in the construction of FIG. 7(*a*), when the two substrates are combined.

Next, functions of floating conductor 16 are described.

As mentioned in the first embodiment, a very strong electric field concentrations occurs at ignition gap 15 between peak 14 of phosphor layer 12 coated on the side of partition 11 and protect film 7, when the write pulse is applied. Therefore, a voltage far exceeding the discharge voltage of ignition gap 15 is applied to ignition gap 15, and a discharge fires at ignition gap 15 with almost no long discharge delay.

However, if wall charge accumulated on the surface of protect film 7 made of MgO is not enough before a write discharge, the write discharge may not occur at discharge cell 13. The reason is that MgO thin-film has an excellent insulating property in general, and has very little wall charge on a surface of it, therefore, the very little wall charge lis discharged and weakens the electric field concentration.

For this reason, the floating conductor is used to provide enough charged particles, and to make the pilot discharge reliable, as described below.

A function of floating conductor 16 is to provide enough charge to ignition gap 15, at which the pilot discharge occurs to transfer to a main discharge. More specifically, in the case where floating conductor 16 is formed between dielectric layer 6 and protect film 7, when the pilot discharge occurs at ignition gap 15, electric charge is provided from floating conductor 16 via protect film 7 to ignition gap 15.

In the case where floating conductor 16 is formed on protect film 7, when the pilot discharge occurs at ignition gap 15, electric charge is provided from floating conductor 16 directly to ignition gap 15. This makes the pilot discharge continue until the pilot discharge occurred at ignition gap 15 grows enough to large scale to transfer to a main discharge.

This allows the discharge at ignition gap 15 to provide enough charged particles to the main discharge. Therefore, the charged particles produced at ignition gap 15 acts as "pilot flame" to stimulate a main discharge, and allows a write discharge as the main discharge to occur with almost no statistical delay. As a result, the panel of the embodiment makes the display quality higher than a conventional panel.

The embodiment described above is a case where a main discharge is a write discharge. However, in a case where a main discharge is caused with a voltage applied between a data electrode and scan electrode or between a data electrode and sustain electrode, the same effect described above can be expected.

And, the embodiment described above is a case where ZnO is used as a conductive material. However, in a case where some of indium oxide (ITO), tin oxide ($SnO_2$), indium-tin oxide (ITO) and the like other than ZnO are used as a conductive material, the same effect described above can be expected.

Further, the phosphor material is not restricted to only the abovementioned embodiments show.

Further, in a case where a red phosphor layer or a blue phosphor layer mixed with conductive material is used, the same effect described above can be expected.

As explained above, in the plasma display panel of the present invention, each discharge cell has an ignition gap, which effectively becomes a very narrow gap formed between a peak of a phosphor layer coated on a side of a partition and a front substrate.

Therefore, when the write pulse is applied, a very strong electric field concentration occurs across the ignition gap. As a result, a discharge starts at the ignition gap with almost no long discharge delay. Since charged particles produced by the discharge act as "a pilot flame", and stimulate a discharge, a write discharge occurs with almost no statistical delay. Consequently, the present invention reduces non-emitting cells corresponding to a write operation failure, and provides AC plasma display device with no loss of image quality.

Furthermore, the present invention allows a period a write operation needs to be reduced, and is useful for a large frame panel and a high definition display panel having larger numbers of scan lines.

What is claimed:

1. An AC plasma display device comprises:

a) a first transparent substrate on a front side;

b) a second substrate facing said first substrate and defining a discharge space therebetween in a display region;

c) a plurality of discharge cells defined by a partition dividing the discharge space, wherein each of said plurality of discharge cells defines an ignition gap, at which a pilot discharge may occur to stimulate a main discharge, and d) an electrically floating conductor arranged on said first substrate to permit a main discharge to occur at a discharge cell.

2. An AC plasma display device comprises:

a) a first transparent substrate on a front side;

b) a second substrate facing said first transparent substrate and defining a discharge space therebetween;

c) a plurality of discharge cells defined by a partition dividing the discharge space;

d) an electrode arranged on said first substrate to permit a main discharge to occur at said discharge cell, wherein a side of the partition includes a conductive phosphor layer formed thereon, and the conductive phosphor layer on the side of the partition and a surface of said first transparent substrate define an ignition gap therebetween.

3. The AC plasma display panel device according to claim 2, wherein the conductive phosphor layer includes zinc oxide.

4. The AC plasma display panel device according to claim 2, wherein said first transparent substrate includes an electrically floating conductor formed thereon.

5. An AC plasma display device comprises:

a) a transparent front substrate including a plurality of display electrodes located thereon and arranged in a stripe shape, a dielectric layer covering the display electrodes, and an easily dischargeable insulating film located on the dielectric layer;

b) a rear substrate facing said front substrate and defining a discharge space between said front substrate and said rear substrate, said rear substrate having plural lines of data electrodes arranged thereon and extending in perpendicular direction to the display electrodes;

c) a partition dividing the discharge space into a plurality of discharge cells between the data electrodes on said rear substrate, wherein a side of the partition includes a conductive phosphor layer formed thereon, and the conductive phosphor layer on the side of the partition and a surface of said front substrate define a gap therebetween, the dielectric layer and the easily dischargeable insulating film include an electrically floating conductor arranged therebetween, and the electrically floating conductor and the phosphor layer define an ignition gap therebetween.

6. The AC plasma display panel device according to claim 5, wherein the conductive phosphor layer includes zinc oxide.

7. An AC plasma display device comprises:

a) a transparent front substrate including a plurality of display electrodes located thereon and arranged in a stripe shape, dielectric layer covering the display electrodes, an easily dischargeable insulating film located on the dielectric layer;

b) a rear substrate facing said front substrate and defining a discharge space between said front substrate and said rear substrate, said rear substrate having plural lines of data electrodes arranged thereon and extending in perpendicular direction to the display electrodes;

c) a partition dividing the discharge space into a plurality of discharge cells between the data electrodes on said rear substrate, wherein a side of the partition includes a conductive phosphor layer formed thereon, and the conductive phosphor layer on the side of the partition and a surface of said front substrate define an ignition gap therebetween, said front substrate has an electrically floating conductor arranged on a surface thereof and facing the discharge space, and the electrically floating conductor and the phosphor layer define said ignition gap therebetween.

8. The AC plasma display panel device according to claim 7, wherein the conductive phosphor layer includes zinc oxide.

* * * * *